US011471894B2

(12) United States Patent
Yu et al.

(10) Patent No.: US 11,471,894 B2
(45) Date of Patent: Oct. 18, 2022

(54) SUPPORT DEVICE AND HIGH-SPEED PULVERIZER HAVING THE SAME

(71) Applicant: Sealdo Technologies Corporation, Changzhou (CN)

(72) Inventors: Songbao Yu, Changzhou (CN); Lin Xiao, Changzhou (CN)

(73) Assignee: SEALDO TECHNOLOGIES CORPORATION, Changzhou (CN)

( * ) Notice: Subject to any disclaimer, the term of this patent is extended or adjusted under 35 U.S.C. 154(b) by 103 days.

(21) Appl. No.: 17/006,918

(22) Filed: Aug. 31, 2020

(65) Prior Publication Data

US 2021/0331180 A1 Oct. 28, 2021

(30) Foreign Application Priority Data

Apr. 24, 2020 (CN) ..... 202020644639.4

(51) Int. Cl.
*B02C 18/24* (2006.01)
*B02C 18/12* (2006.01)

(52) U.S. Cl.
CPC ..... *B02C 18/24* (2013.01); *B02C 18/12* (2013.01)

(58) Field of Classification Search
CPC ..... B02C 18/24; B02C 18/12
See application file for complete search history.

(56) References Cited

U.S. PATENT DOCUMENTS 1,517,564 A * 12/1924 Lowe ..... B02C 18/12 241/114
3,369,583 A * 2/1968 Schnell ..... B02C 18/12 241/85
3,380,499 A * 4/1968 Vocci ..... B02C 18/12 241/199.12
3,606,178 A * 9/1971 Klopp ..... B02C 18/12 241/282.1
3,612,126 A * 10/1971 Emmons ..... A47J 43/0766 192/89.1
5,236,135 A * 8/1993 Wilson ..... A61L 11/00 241/606
5,516,052 A * 5/1996 Adams ..... A61B 50/13 241/606
2003/0029947 A1* 2/2003 Strutz ..... E03C 1/2665 241/46.013
2012/0234950 A1* 9/2012 Hammer ..... H02K 5/1672 310/90
2015/0115076 A1* 4/2015 Gormley ..... B02C 18/24 241/36

* cited by examiner

*Primary Examiner* — Jessica Cahill
*Assistant Examiner* — Mohammed S. Alawadi
(74) *Attorney, Agent, or Firm* — Leong C. Lei

(57) ABSTRACT

A support device and a high-speed pulverizer having the support device are disclosed. The support device includes an outer casing. The outer casing has a mounting cavity therein. A bearing is retained in the mounting cavity through a sealing member. The sealing member is a movable structure that is flexibly connected, which realizes automatic centering in the working process, improves the service life of the bearing and the sealing member, and realizes the effect of vibration reduction and noise reduction.

9 Claims, 2 Drawing Sheets

SUPPORT DEVICE AND HIGH-SPEED PULVERIZER HAVING THE SAME

BACKGROUND OF THE INVENTION

1. Field of the Invention

The present invention relates to a support device, and more particularly to a support device and a high-speed pulverizer having the support device.

2. Description of the Prior Art

A conventional high-speed pulverizer consists of a main machine and a cup body. The main machine includes a motor and a transmission. The main machine is configured to output power. A blade is fixed on a cutter shaft connected to the transmission. A support unit is provided on the cutter shaft. The support unit is composed of an outer casing, a bearing, and a sealing member.

However, the conventional high-speed pulverizer has the following defects:

1. The installation of the main machine and the cup body is not concentric, and the transmission outputs a lateral force, resulting in a short life of the bearing and the sealing member of the support unit.

2. The outer casing is rigidly connected with the bearing and the pulverizing cavity, which results in a loud noise generated by high-speed rotation.

SUMMARY OF THE INVENTION

In view of the shortcomings of the prior art, the present invention provides a support device and a high-speed pulverizer having the support device, which can prolong the service life of a bearing and reduce noise.

In order to achieve the above object, the present invention adopts the following solutions.

A support device comprises an outer casing. The outer casing has a mounting cavity therein. A bearing is retained in the mounting cavity through a sealing member.

Preferably, an upper limiting ring and a lower limiting ring are fixedly connected to two ends of the outer casing, respectively. The sealing member is installed between the upper limiting ring and the lower limiting ring.

Preferably, the sealing member has an accommodating cavity therein. The bearing is installed in the accommodating cavity.

Preferably, the sealing member includes an upper sealing ring and a lower sealing ring. An inner casing is connected between the upper sealing ring and the lower sealing ring. The bearing is retained in the inner casing.

Preferably, the upper sealing ring includes an upper outer ring and an upper inner ring. An upper end of the inner casing is inserted between the upper outer ring and the upper inner ring. The upper outer ring and the upper inner ring clamp the upper end of the inner casing tightly. A lower end of the inner casing abuts against a side of the lower sealing ring facing the upper sealing ring.

Preferably, the inner casing includes an upper inner casing and a lower inner casing. The upper inner casing has an outer diameter less than that of the lower inner casing. A connecting ring is connected between the upper inner casing and the lower inner casing. A positioning ring is fixedly connected to an upper end of the upper inner casing. The upper inner ring is installed between the bearing and the positioning ring. The upper outer ring is installed between the upper limiting ring and the connecting ring.

Preferably, the outer casing includes an upper outer casing and a lower outer casing. An outer wall of the upper outer casing is threadedly connected with an inner wall of the lower outer casing.

Preferably, an inner wall of the upper inner ring is in interference fit with a cutter shaft. An inner wall of the lower sealing ring is in interference or clearance fit with the cutter shaft.

Preferably, a space is defined among the upper sealing ring, the lower sealing ring, the inner casing and the outer casing. A one-way structure is provided on any one of the upper sealing ring, the lower sealing ring, the inner casing and the outer casing.

A high-speed pulverizer comprises a cup body, a transmission, a cutter shaft, a blade, and the above-mentioned support device. The support device is fixed in the cup body. One end of the cutter shaft is connected to the transmission, and another end of the cutter shaft passes through the support device and is fixedly connected to the blade.

In summary, the beneficial effects of the present invention are described below.

1. The sealing member is a movable structure that is flexibly connected, which realizes automatic centering in the working process, improves the service life of the bearing and the sealing member, and realizes the effect of vibration reduction and noise reduction.

2. A space is defined in the outer casing. The space can be evacuated to be in a vacuum state, so as to achieve sound insulation and noise reduction.

3. The bearing is a fully sealed structure to reduce dust and liquid from entering the bearing and to prolong the service life of the bearing.

DETAILED DESCRIPTION OF THE PREFERRED EMBODIMENTS

Embodiments of the present invention will now be described, by way of example only, with reference to the accompanying drawings.

Embodiments of a support device and a high-speed pulverizer having the support device of the present invention will be further described with reference to FIG. 1 and FIG. 2.

Figure 2:
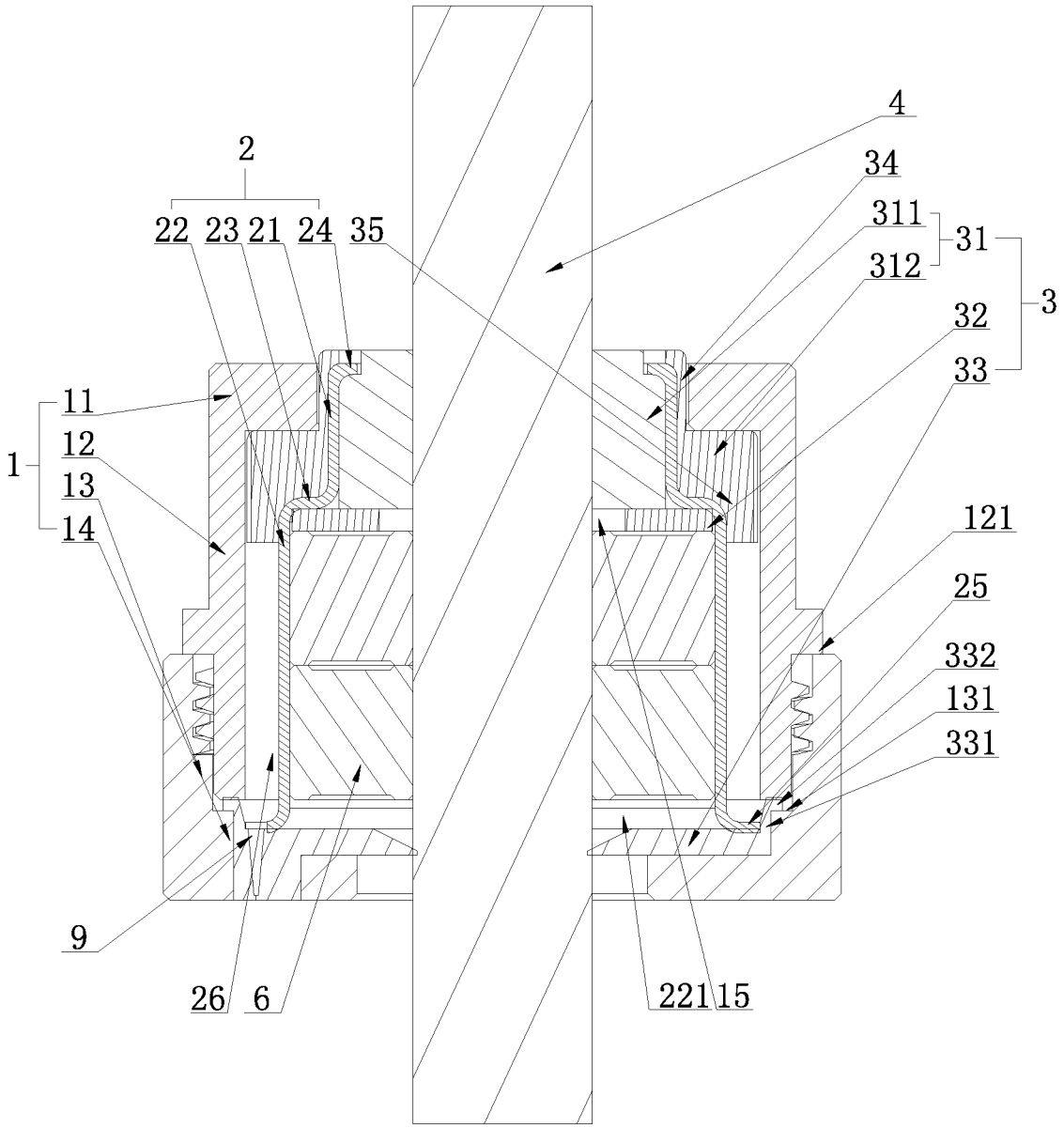
FIG. 2 is a schematic view of a support device according to an embodiment of the present invention.

As shown in FIG. 2, a support device 7 includes an outer casing 1. The outer casing 1 has a mounting cavity 15 therein. A bearing 6 is retained in the mounting cavity 15 through a sealing member 3. The sealing member 3 is made of a flexible material, such as rubber, silicone, etc., so that the bearing 6 is movable relative to the outer casing 1.

As shown in FIG. 2, an upper limiting ring 11 and a lower limiting ring 14 are fixedly connected to two ends of the outer casing 1, respectively. The inner diameters of the upper limiting ring 11 and the lower limiting ring 14 are smaller than the inner diameter of the mounting cavity 15. The sealing member 3 is installed between the upper limiting ring 11 and the lower limiting ring 14. The sealing member 3 has an accommodating cavity 221 therein. The bearing 6 is installed in the accommodating cavity 221.

As shown in FIG. 2, the sealing member 3 includes an upper sealing ring 31 and a lower sealing ring 33. An inner casing 2 is connected between the upper sealing ring 31 and the lower sealing ring 33. The inner casing 2 is made of a hard material. The accommodating cavity 221 is arranged in the inner casing 2. The bearing 6 is retained in the accommodating cavity 221 of the inner casing 2. The connection of the inner casing 2 and the sealing member 3 is described below. The upper sealing ring 31 includes an upper outer ring 312 and an upper inner ring 311. An upper end of the inner casing 2 is inserted between the upper outer ring 312 and the upper inner ring 311. The upper outer ring 312 and the upper inner ring 311 clamp the upper end of the inner casing 2 tightly. A lower end of the inner casing 2 abuts against a side of the lower sealing ring 33 facing the upper sealing ring 31. The upper sealing ring 31, the lower sealing ring 33 and the inner casing 2 are confined in the outer casing 1.

In order to increase the sealability between the upper outer ring 312, the upper inner ring 311 and the upper end of the inner casing 2, as shown in FIG. 2, the inner casing 2 includes an upper inner casing 21 and a lower inner casing 22. The outer diameter of the upper inner casing 21 is less than the outer diameter of the lower inner casing 22. A connecting ring 23 is connected between the upper inner casing 21 and the lower inner casing 22. A positioning ring 24 is fixedly connected to an upper end of the upper inner casing 21. The upper inner ring 311 is installed between the bearing 6 and the positioning ring 24. The upper outer ring 312 is installed between the upper limiting ring 11 and the connecting ring 23. An upper protruding ring 34 is fixedly connected to an upper end of the upper outer ring 312. The upper protruding ring 34 is arranged between the upper limiting ring 11 and the upper inner ring 311. A lower protruding ring 35 is fixedly connected to a lower end of the upper outer ring 312. The lower protruding ring 35 is arranged between the upper outer casing 12 and the lower inner casing 22. Two bearings 6 are installed in the accommodating cavity 221 of the lower inner casing 22. A separation ring 32 is provided between the upper bearing 6 and the connecting ring 23. The separation ring 32 may be made a flexible material.

In order to facilitate the installation of the bearing 6 and the sealing member 3, the outer casing 1 includes an upper outer casing 12 and a lower outer casing 13. The upper limiting ring 11 is fixedly connected to an upper end of the upper outer casing 12. The lower limiting ring 14 is fixedly connected to a lower end of the lower outer casing 13. The outer wall of the upper outer casing 12 is threadedly connected with the inner wall of the lower outer casing 13.

An outer flange 25 is fixedly connected to a lower end of the lower inner casing 22. The lower sealing ring 33 is pressed between the outer flange 25 and the lower limiting ring 14. A lower extension ring 331 is fixedly connected to an upper end of the lower sealing ring 33. A sealing flange 332 is fixedly connected to an upper end of the lower extension ring 331. The sealing flange 332 is pressed between a lower step 131 of the inner wall of the lower outer casing 13 and the lower end face of the upper outer casing 12, thereby increasing the sealability of the threaded connection between the upper outer casing 12 and the lower outer casing 13.

As shown in FIG. 2, a space 26 is formed among the upper sealing ring 31, the lower sealing ring 33, the inner casing 2 and the outer casing 1. A one-way structure 9 is provided on any one of the upper sealing ring 31, the lower sealing ring 33, the inner casing 2 and the outer casing 1. The space 26 is evacuated to be in a vacuum state through the one-way structure 9, so as to achieve sound insulation and noise reduction. The one-way structure 9 may be a one-way valve or the like. After the space 26 is evacuated, the one-way structure 9 seals the space 26 to prevent air from entering the space 26.

When the lower outer casing 13 is screwed upward, the lower limiting ring 14 drives the lower sealing ring 33 to move upward. The lower sealing ring 33, the sealing flange 332, the separation ring 32, the upper outer ring 312 and the upper inner ring 311 that are all made of flexible materials are squeezed and deformed, thereby increasing the sealability among the outer casing 1, the bearing 6, and a cutter shaft 4, reducing dust and liquid entering the bearing 6 and prolonging the service life of the bearing 6. A positioning protrusive ring 121 is fixedly connected to the outer wall of the upper outer casing 12. When the upper end face of the lower outer casing 13 abuts against the lower end face of the positioning protrusive ring 121, the lower outer casing 13 is screwed into place.

Figure 1:
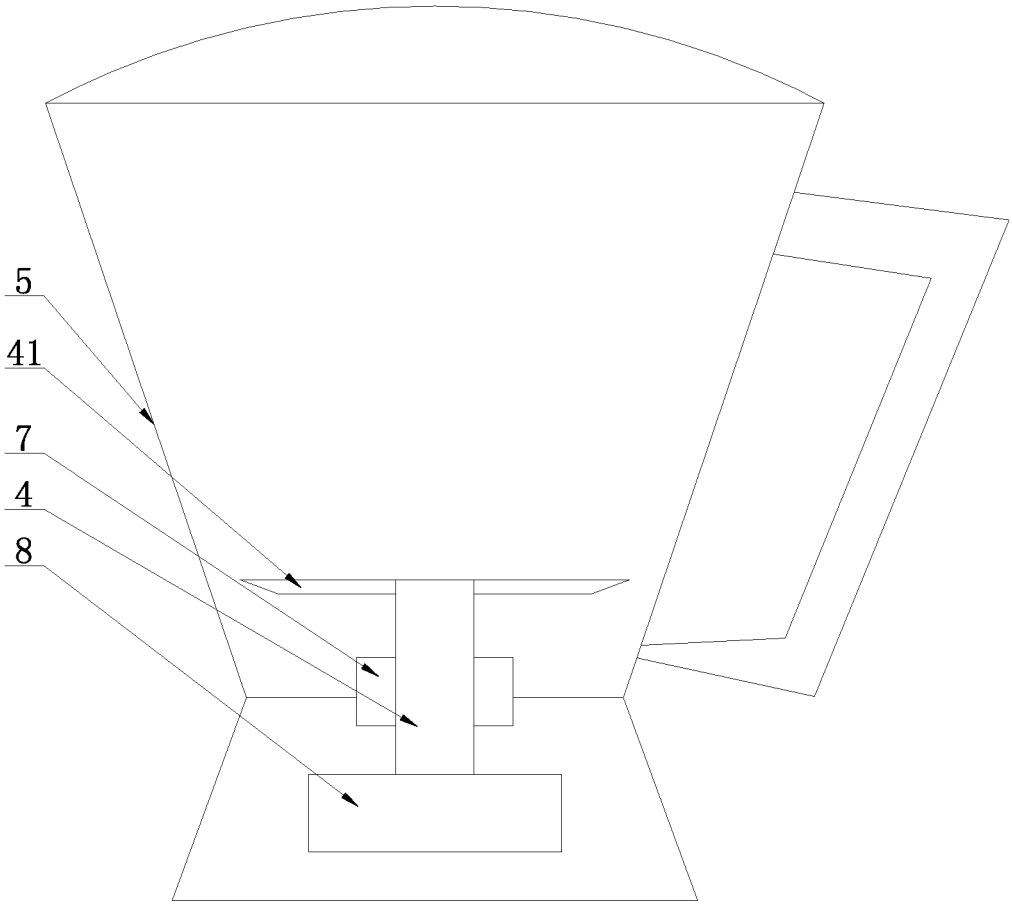
FIG. 1 is a schematic view of a high-speed pulverizer according to an embodiment of the present invention.

As shown in FIG. 1 and FIG. 2, a high-speed pulverizer comprises a cup body 5, a transmission 8, a cutter shaft 4, a blade 41 and a support device 7. The support device 7 is fixed in the cup body 5. A lower end of the cutter shaft 4 is connected to the transmission 8. An upper end of the cutter shaft 4 sequentially passes through the lower limiting ring 14, the lower sealing ring 33, the bearing 6 and the upper inner ring 311. The blade 41 is fixed on the upper end of the cutter shaft 4. The inner wall of the upper inner ring 311 is in interference fit with the cutter shaft 4. The inner wall of the lower sealing ring 33 is in interference or clearance fit with the cutter shaft 4. When a lateral force is given to the bearing 6 during the rotation of the cutter shaft 4, the bearing 6 will squeeze the upper sealing ring 31 and the lower sealing ring 33, and the upper sealing ring 31 and the lower sealing ring 33 will deform accordingly. This can prolong the service life of the bearing 6 and reduce the noise between the cutter shaft 4 and the bearing 6 when the cutter shaft 4 rotates.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A support device, comprising an outer casing, the outer casing having a mounting cavity therein, a bearing being retained in the mounting cavity through a sealing member, wherein an inner casing is arranged in an interior space of the outer casing, the inner casing having an interior space that forms the mounting cavity, such that the bearing that is retained in the mounting cavity is fixed inside the inner casing;

wherein the sealing member is interposed between the outer casing and the inner casing; and wherein the sealing member is made of an elastic material that supports the inner casing inside the outer casing in a movable manner, such that the bearing that is fixed inside the inner casing is flexibly and movably supported in the interior space of the outer casing by means of the elastic material of the sealing member.

2. The support device as claimed in claim 1, wherein an upper limiting ring and a lower limiting ring are fixedly connected to two ends of the outer casing respectively, and the sealing member is installed between the upper limiting ring and the lower limiting ring.

3. The support device as claimed in claim 1, wherein the sealing member includes an upper sealing ring and a lower sealing ring, and the inner casing is connected between the upper sealing ring and the lower sealing ring.

4. The support device as claimed in claim 3, wherein the upper sealing ring includes an upper outer ring and an upper inner ring, an upper end of the inner casing is inserted between the upper outer ring and the upper inner ring, the upper outer ring and the upper inner ring clamp the upper end of the inner casing, and a lower end of the inner casing abuts against a side of the lower sealing ring facing the upper sealing ring.

5. The support device as claimed in claim 4, wherein the inner casing includes an upper inner casing and a lower inner casing, the upper inner casing has an outer diameter less than that of the lower inner casing, a connecting ring is connected between the upper inner casing and the lower inner casing, a positioning ring is fixedly connected to an upper end of the upper inner casing, the upper inner ring is installed between the bearing and the positioning ring, and the upper outer ring is installed between the upper limiting ring and the connecting ring.

6. The support device as claimed in claim 3, wherein an inner wall of the upper inner ring is in interference fit with a cutter shaft, and an inner wall of the lower sealing ring is in interference or clearance fit with the cutter shaft.

7. The support device as claimed in claim 3, wherein a space is defined among the upper sealing ring, the lower sealing ring, the inner casing and the outer casing, and a one-way structure is provided on one of the upper sealing ring, the lower sealing ring, the inner casing and the outer casing to evacuate the space, so that the space is set in a vacuum state.

8. The support device as claimed in claim 1, wherein the outer casing includes an upper outer casing and a lower outer casing, and an outer wall of the upper outer casing is threadedly connected with an inner wall of the lower outer casing.

9. A high-speed pulverizer, comprising a cup body, a transmission, a cutter shaft, a blade and the support device as claimed in claim 1, the support device being fixed in the cup body, one end of the cutter shaft being connected to the transmission, another end of the cutter shaft passing through the support device and being fixedly connected to the blade.

* * * * *